US005211394A

United States Patent [19]

Jackson et al.

[11] Patent Number: 5,211,394

[45] Date of Patent: May 18, 1993

[54] BASEBALL HITTING GAME

[76] Inventors: David M. Jackson, 5204 Tamarus, #A, Las Vegas, Nev. 89119; Chauncey L. Mann, III, 1457 Elma St., #A, Ontario, Calif. 91764

[21] Appl. No.: 385,569

[22] Filed: Jul. 26, 1989

[51] Int. Cl.[5] ..... A63B 67/00

[52] U.S. Cl. ..... 273/25

[58] Field of Search ..... 273/26 R, 411, 25; 272/3

[56] References Cited

U.S. PATENT DOCUMENTS

| | | | |
|---|---|---|---|
| 2,545,615 | 3/1951 | Hatley | 273/411 |
| 2,812,946 | 11/1957 | Hughes | 273/411 |
| 2,964,321 | 12/1960 | Anderson | 273/411 |
| 3,554,551 | 1/1971 | Apiki | 273/411 |
| 3,830,497 | 8/1974 | Peterson | 273/411 |
| 4,166,617 | 9/1979 | Jesus | 273/411 |
| 4,203,595 | 5/1980 | Thompson | 273/25 |
| 4,758,002 | 7/1988 | Murphy | 273/25 |
| 4,781,385 | 11/1988 | Harley | 273/411 |
| 4,798,389 | 1/1989 | Long | 273/25 |

*Primary Examiner*—Theatrice Brown

*Attorney, Agent, or Firm*—John Edward Roethel

[57] ABSTRACT

A playing field that utilizes a conventional baseball diamond includes, beginning at the back of the infield, arcuate segments lined off in the outfield to create scoring zones. The last line or the field's boundary fence is the home run zone. Additionally, a plurality of vertical hoops are placed at selected locations in the playing field with the opening of the hoop facing home plate.

A hitter scores points for hitting the ball on the fly into a particular segment of the playing field. The farther the hitter can hit the ball of the fly, the more points the player can score. The hitter receives the most points for hitting the ball over the last boundary line or over the boundary fence—a home run. The player also receives points for hitting the ball through one of the vertical hoops. The ability of the hitter to achieve points for hitting the ball through the vertical hoops creates parity between the placement hitter and the home run hitter.

13 Claims, 1 Drawing Sheet

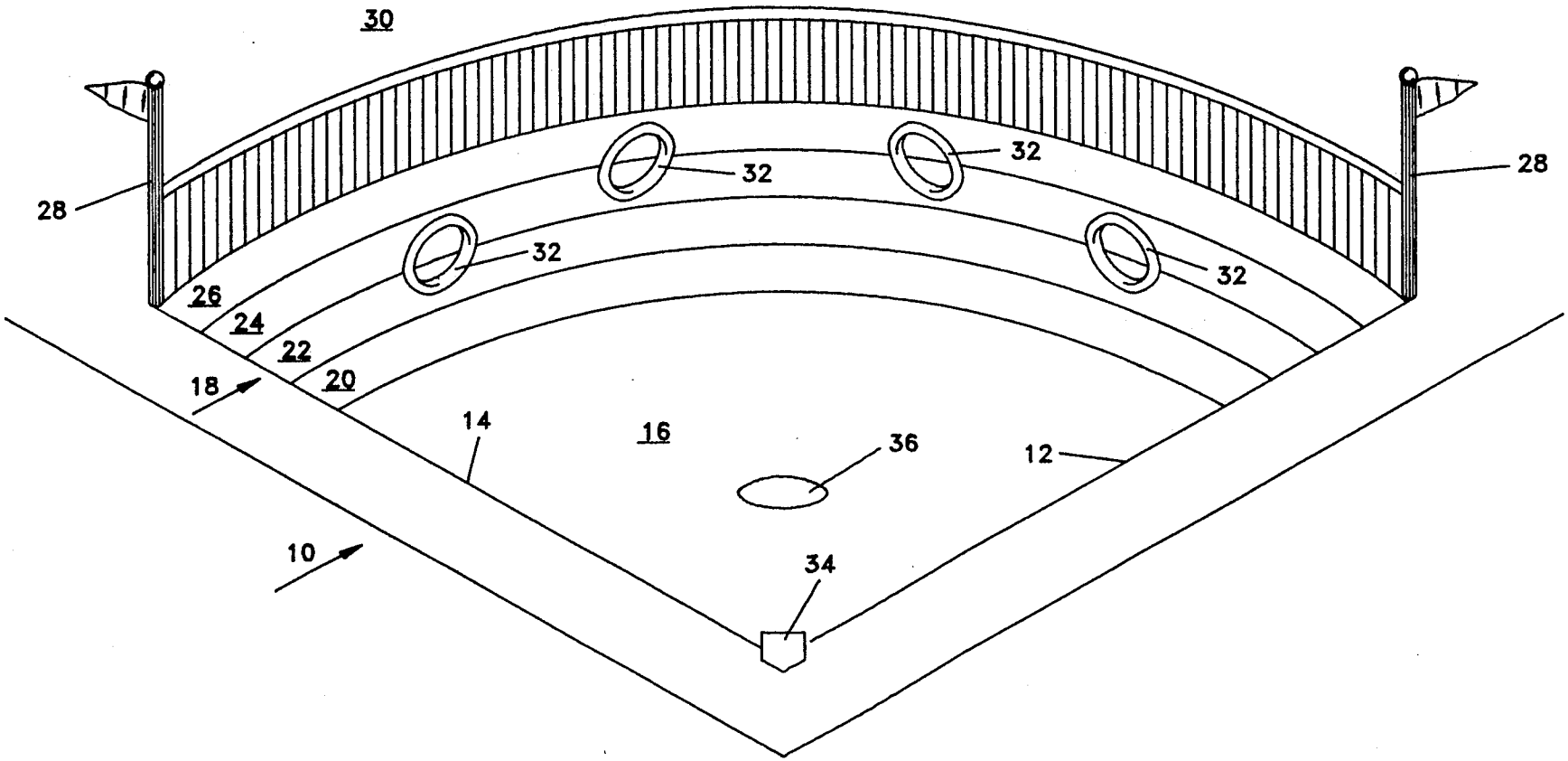
28
32
32
32
32
30
26
24
22
20
18
14
16
12
36
34
10
28

BASEBALL HITTING GAME

BACKGROUND OF THE INVENTION

This invention relates to baseball, and more particularly to a method and playing field for conducting a baseball hitting game.

Baseball is a game that has been enjoyed by young and old for many years. Even the most casual sports fan knows the rules of baseball and almost everyone has played the game at one time in their life.

The object of baseball is to hit a pitched ball into the boundaries of a playing field and safely reach base. If a player can successfully round the bases, his team scores a run. The team with the most runs at the end of the game wins.

The present invention involves utilizing one of the basic elements of baseball—hitting a pitched ball into the baseball playing field. Sports fans have long admired the ability of athletes to hit a pitched baseball and there have been many long debates over whether a power hitter or a placement hitter is the better athlete at hitting a baseball. It has also been said that the most difficult feat in sport is to hit a round ball with a round bat.

Many baseball game have been developed utilizing the hitting element of baseball. For example, a game known as "Home Run Derby" involved two players competing against each other to see who can hit the most home runs. Each game consisted of nine innings. Each inning comprised the first player batting against a pitcher until the first player made three outs, then the second player would bat until he made three outs. An out was any ball that was swung at by the player and was not hit over the fence for a home run. Whichever player had the most home runs at the end of nine innings won the game.

While "Home Run Derby" was a very successful game and was even a television series in the 1950's, "Home Run Derby" rewarded power hitters and did not give appropriate credit to batters who could not hit home runs but could control the placement of the ball in the playing field.

It is an object of the present invention to create a baseball hitting game that rewards equally the ability to hit a baseball a long distance and the ability to hit a baseball to a particular location. It is a further object of the present invention to create a playing field that can be used to play the game of the present invention.

It is a feature of the present invention that a hitter score points for hitting home runs and also scores points for hitting the ball to a particular location.

It is an advantage of the present invention that power hitters and placement hitters can compete on an equal basis in a contest of skill related to the ability to hit a baseball.

SUMMARY OF THE INVENTION

A playing field is provided that utilizes a conventional baseball diamond. Beginning at the back of the infield, arcuate segments are lined off in the outfield to create scoring zones. The last line or the field's boundary fence is the home run zone.

Additionally, a plurality of vertical hoops are placed at selected locations in the playing field with the opening of the hoop facing home plate.

The hitter scores points for hitting the ball on the fly into a particular segment of the playing field. The farther the hitter can hit the ball of the fly, the more points the player can score. The hitter receives the most points for hitting the ball over the last boundary line or over the boundary fence—a home run. The player also receives points for hitting the ball through one of the vertical hoops. The ability of the hitter to achieve points for hitting the ball through the vertical hoops creates parity between the placement hitter and the home run hitter.

The game of the present invention can also be played as a contest between two hitters or teams of hitters. Whichever hitter or team scores the most points during the game is the winner. The parity feature of the game allows a power hitter to be matched against a placement hitter to see who is the better hitter.

BRIEF DESCRIPTION OF THE DRAWING

The Figure shows a conventional baseball field modified to play the game of the present invention.

DETAILED DESCRIPTION OF THE PREFERRED EMBODIMENTS

As shown in the Figure, the game of the present invention is played on a conventional baseball playing field 10 that has been modified. The baseball playing field 10 comprises one quarter of a circle and the lateral boundaries are defined by a right foul line 12 and a left foul line 14. The area between the foul lines, and including the foul lines themselves, is known as fair territory. The conventional baseball playing field is also divided into two distinct areas known as the infield 16 and the outfield 18.

A ball must be hit in the area between the foul lines, i.e. fair territory, in order for the hitter to score points. Also, in order for the hitter to score points, the ball must be hit "on the fly", i.e. without hitting the ground, over the infield 16 and into the outfield 18.

The outfield is divided into a plurality of arcuate segments 20, 22, 24 and 26 extending from the right foul line to the left foul line. The dividing lines between the segments can be lines marked on the field. In the preferred embodiment, the arcuate segments 20, 22, 24 and 26 have equal widths, although the width of each segment can be varied and still fall within the scope of the invention.

The farthest boundary of the baseball playing field may be bordered by a fence 28 of any appropriate height. Alternatively, the boundary of the outfield may simply be demarcated by a boundary line marked on the field.

Also placed at various locations in the outfield 18 are vertical hoops 32. In the preferred embodiment, each hoop 32 is generally circular in cross section, although other shapes such as squares or ovals may be used. Each hoop preferably faces toward home plate 34. Any number of vertical hoops may be used, but the preferred number is four.

The play of the game is as follows. A pitcher standing on the pitcher's mound 36 throws a ball toward home plate where a hitter has taken the hitting position such as is conventional in the game of baseball. Alternatively, a pitching machine can be used in lieu of a line pitcher. Using a typical baseball bat, the hitter attempts to hit the ball into the outfield. Depending on where the ball lands on the fly, the hitter may score points. If the hitter hits the ball in foul territory, i.e. to the right of the right foul line 12 or to the left of the left foul line, then the player is charged with a strike. If the hitter swings and misses the pitch, he is also charged with a strike. If the hitter hits the ball so that it first lands on the fly in the infield area 16, he is also charged with a strike. Finally, if the hitter does not swing at the ball yet the ball passes through the conventional "strike zone", he is also charged with a strike. The conventional "strike zone" is defined by the rules of baseball and is generally considered to be that rectangular area over home plate from the top of the hitter's knees to the bottom of the hitter's armpits. The particular "strike zone" used is not critical, and, in fact, the game may be played without charging the hitter with a strike if the hitter does not swing.

In the preferred embodiment, if the hitter hits the ball on the fly into fair territory, he will score points based on the following preferred scoring point values. If the ball first lands on the fly in segment 20, the hitter receives one point. If in segment 22, two points. If in segment 24, three points. If in segment 26, four points. If the ball should land directly on a dividing line between the segments, the player will receive the points for the higher scoring segment. If the ball first hits the fence 28 on the fly, five points. If the ball goes over the fence 28 into the area 30, six points. If the ball on the fly goes through any one of the vertical hoops 32, six points.

In the preferred embodiment, the hitter does not receive points for the ball both going through a hoop and landing in a particular segment. Thus, in the preferred embodiment, a hitter who can place the ball through a hoop, i.e. a "placement hitter", will score the same points for his accuracy that a hitter who can hit the ball over the fence 28, a "power hitter", will receive. This puts the placement hitter in parity with the power hitter.

The particular designation of points is not critical, but may be adjusted as desired. However, to achieve parity between the placement hitter and the power hitter, the preferred embodiment awards equal points to a hit through a hoop 32 and a hit over the fence 28.

The size of the vertical hoops 32 is not critical but should be selected to make it as relatively easy or difficult for the placement hitter to place the ball through a vertical hoop 32 as it is for a power hitter to hit the ball over the fence 28. In the preferred embodiment, the vertical hoops 32 will have a diameter generally between 15 feet and 30 feet, and most preferably a diameter of approximately 20 feet.

The game of the present invention can also be played in a competition format involving two players or two teams of players. Each player receives a first predetermined number of strikes. Out of those strikes, each player receives a second predetermined number of swings. Out of those swings, each player can score points for a third predetermined number of hits. Whichever player or team of players scores the most points wins the competition In the preferred embodiment, each player receives ten strikes. Out of those strikes, each player receives six swings. Out of those swings, each player can score points for four hits. The number of strikes, the number of swings and the number of hits can be varied without departing from the present invention.

In the event of a tie score at the end of an particular game, the tie can be broken by awarding the win to the player or team of players who used the fewest strikes to achieve his predetermined number of swings. If a tie still exists at that point, a sudden death playoff format can be utilized to break the tie.

Various modifications ca also be made to the present invention. The number of points that are applied to each feature of the playing field can be varied. Any type of ball can be used to play the game, but it is preferred that either a baseball or a softball be used. The size of the strike zone can be varied, but it is preferred that the conventional strike zone determined by either the rules of baseball or the rules of softball be used. Finally, more than two players can compete in the competition format of the game. For example, after one round of the game, a certain number of players scoring the most points, such as the top ten players, can advance to the second round. A preselected number of players are eliminated each round until an eventual winner is determined. Similarly team competition can be conducted with the teams having the most points at the end of each round advancing to the next round and so on until a single winning team has been determined.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a ball game comprising:

a) pitching a ball to a hitter;

b) the hitter determining whether to swing at the ball;

c) if the hitter does not swing at the ball and the ball passes through a strike zone, the hitter is charged with a strike;

d) if the hitter swings at the ball and misses, the hitter is charged with a strike;

e) if the hitter swings at the ball and hits it, then 1) if the ball goes into a predetermined area on the fly, then the hitter receives a preselected number of points, or 2) if the ball does not go into the predetermined area on the fly, then the hitter receives a strike;

f) the predetermined area includes four marked off segments on a playing field, each segment is designated with a preselected point value, the point value of the first segment is one, the point value of the second segment is two, the point value of the third segment is three and the point value of the fourth segment is four;

g) the predetermined area further includes at least one vertical hoop placed on the playing field and facing the hitter, the vertical hoop having a diameter of approximately between 15 feet and 30 feet and a hitter scores points for hitting the ball on the fly through the vertical hoop, and h) adding up the hitter's points after the hitter has received a certain number of pitches.

2. The method of claim 1 wherein the vertical hoop is approximately 20 feet in diameter.

3. A method of playing a ball game comprising:

a) pitching a ball to a hitter;

b) the hitter determining whether to swing at the ball;

c) if the hitter does not swing at the ball and the ball passes through a strike zone, the hitter is charged with a strike;

d) if the hitter swings at the ball and misses, the hitter is charged with a strike;

e) if the hitter swings at the ball and hits it, then 1) if the ball goes into a predetermined area on the fly, then the hitter receives a preselected number of points, or
2) if the ball does not go into the predetermined area on the fly, then the hitter receives a strike;

f) the predetermined area includes four marked off segments on a playing field, each segment is designated with a preselected point value, the point value of the first segment is one, the point value of the second segment is two, the point value of the third segment is three and the point value of the fourth segment is four;

g) the predetermined area further includes at least one vertical hoop placed on the playing field and facing the hitter, and the hitter receives six points for hitting the ball on the fly through the vertical hoop, and h) adding up the hitter's points after the hitter has received a certain number of pitches.

4. A method of playing a ball game comprising:

a) pitching a ball to a hitter;

b) the hitter determining whether to swing at the ball;

c) if the hitter does not swing at the ball and the ball passes through a strike zone, the hitter is charged with a strike;

d) if the hitter swings at the ball and misses, the hitter is charged with a strike;

e) if the hitter swings at the ball and hits it, then
1) if the ball goes into a predetermined area on the fly, then the hitter receives a preselected number of points, or
2) if the ball does not go into the predetermined area on the fly, then the hitter receives a strike;

f) the predetermined area includes four marked off segments on a playing field, each segment is designated with a preselected point value, the point value of the first segment is one, the point value of the second segment is two, the point value of the third segment is three and the point value of the fourth segment is four;

g) the predetermined area further includes a plurality of vertical hoops placed on the playing field and facing the hitter, each vertical hoop having a diameter of approximately between 15 feet and 30 feet and a hitter scores points for hitting the ball on the fly through the vertical hoop, and h) adding up the hitter's points after the hitter has received a certain number of pitches.

5. The method of claim 4 wherein each vertical hoop is approximately 20 feet in diameter.

6. A method of playing a ball game comprising:

a) pitching a ball to a hitter;

b) the hitter determining whether to swing at the ball;

c) if the hitter does not swing at the ball and the ball passes through a strike zone, the hitter is charged with a strike;

d) if the hitter swings at the ball and misses, the hitter is charged with a strike;

e) if the hitter swings at the ball and hits it, then
1) if the ball goes into a predetermined area on the fly, then the hitter receives a preselected number of points, or
2) if the ball does not go into the predetermined area on the fly, then the hitter receives a strike;

f) the predetermined area includes four marked off segments on a playing field, each segment is designated with a preselected point value, the point value of the first segment is one, the point value of the second segment is two, the point value of the third segment is three and the point value of the fourth segment is four;

g) the predetermined area further includes a plurality of vertical hoops placed on the playing field and facing the hitter, and the hitter receives six points for hitting the ball on the fly through the any one of the vertical hoops, and h) adding up the hitter's points after the hitter has received a certain number of pitches.

7. A method of playing a ball game comprising:

a) pitching a ball to a hitter;

b) the hitter determining whether to swing at the ball;

c) if the hitter does not swing at the ball and the ball passes through a strike zone, the hitter is charged with a strike;

d) if the hitter swings at the ball and misses, the hitter is charged with a strike;

e) if the hitter swings at the ball and hits it, then
1) if the ball goes into a predetermined area on the fly, then the hitter receives a preselected number of points, or
2) if the ball does not go into the predetermined area on the fly, then the hitter receives a strike;

f) wherein the predetermined area includes at least one vertical hoop placed on the playing field and a hitter scores points for hitting the ball on the fly through the vertical hoop and the hitter receives six points for hitting the ball through the vertical hoop, and g) adding up the hitter's points after the hitter has received a certain number of pitches.

8. A method of playing a ball game comprising:

a) pitching a ball to a hitter;

b) the hitter determining whether to swing at the ball;

c) if the hitter does not swing at the ball and the ball passes through a strike zone, the hitter is charged with a strike;

d) if the hitter swings at the ball and misses, the hitter is charged with a strike;

e) if the hitter swings at the ball and hits it, then
1) if the ball goes into a predetermined area on the fly, then the hitter receives a preselected number of points, or
2) if the ball does not go into the predetermined area on the fly, then the hitter receives a strike;

f) wherein the predetermined area includes a plurality of vertical hoops placed on the playing field and a hitter scores points for hitting the ball on the fly through the vertical hoop and each vertical hoop is approximately the diameter of between 15 feet and 30 feet, and g) adding up the hitter's points after the hitter has received a certain number of pitches.

9. The method of claim 8 wherein each vertical hoop is approximately 20 feet in diameter.

10. A method of playing a ball game comprising:

a) pitching a ball to a hitter;

b) the hitter determining whether to swing at the ball;

c) if the hitter does not swing at the ball and the ball passes through a strike zone, the hitter is charged with a strike;

d) if the hitter swings at the ball and misses, the hitter is charged with a strike;

e) if the hitter swings at the ball and hits it, then
1) if the ball goes into a predetermined area on the fly, then the hitter receives a preselected number of points, or 2) if the ball does not go into the predetermined area on the fly, then the hitter receives a strike;

f) wherein the predetermined area includes a plurality of vertical hoops placed on the playing field and the hitter scores six points for hitting the ball on the fly through any of the vertical hoops, and g) adding up the hitter's points after the hitter has received a certain number of pitches.

11. A ball field comprising:

a) an infield, an outfield, a boundary marker surrounding the outfield, a right foul line and a left foul line, b) the outfield being divided into a plurality of arcuate segments extending from the right foul line to the left foul line, and c) at least one vertical hoop positioned in the outfield, the vertical hoop having the diameter of approximately between 15 feet and 30 feet.

12. The ball field of claim 11 wherein the vertical hoop is approximately 20 feet in diameter.

13. A ball field comprising:

a) an infield, an outfield, a fence surrounding the outfield, a right foul line and a left foul line, b) the outfield being divided into four arcuate segments of the same width extending from the right foul line to the left foul line, and c) four vertical hoops positioned in the outfield, each hoop being approximately 20 feet in diameter.

* * * * *